US005563635A

United States Patent [19]

Kneezel et al.

[11] Patent Number: 5,563,635

[45] Date of Patent: Oct. 8, 1996

[54] POWER CONTROL SYSTEM FOR A THERMAL INK-JET PRINTER

[75] Inventors: Gary A. Kneezel, Webster; Joseph F. Stephany, Williamson; Richard V. LaDonna, Fairport; Thomas E. Watrobski, Penfield; Michael Poleshuk; Joseph J. Wysocki, both of Webster; James N. Eaton, Walworth, all of N.Y.

[73] Assignee: Xerox Corporation, Stamford, Conn.

[21] Appl. No.: 509,396

[22] Filed: Jul. 31, 1995

Related U.S. Application Data

[63] Continuation of Ser. No. 198,714, Feb. 18, 1994, abandoned.

[51] Int. Cl.[6] ..... B41J 2/05

[52] U.S. Cl. ..... 347/12; 347/14; 307/113

[58] Field of Search ..... 347/12, 14, 57, 347/17, 19, 188, 189, 192, 194; 307/28, 29, 39, 43, 112, 113, 115–117, 132 T, 139, 140

[56] References Cited

U.S. PATENT DOCUMENTS

| | | | |
|---|---|---|---|
| 5,017,948 | 5/1991 | Koizumi et al. | 347/14 |
| 5,083,137 | 1/1992 | Badyal et al. | 347/14 |
| 5,144,336 | 9/1992 | Yeung | 347/12 |
| 5,300,968 | 4/1994 | Hawkins | 347/12 |

*Primary Examiner*—Benjamin R. Fuller
*Assistant Examiner*—Craig A. Hallacher
*Attorney, Agent, or Firm*—R. Hutter

[57] ABSTRACT

A power control system in a thermal ink-jet printer facilitates practically instantaneous voltage changes to a heating element. A first set of selectably-actuable voltage lines is operatively connected in parallel to a first terminal of the heating element, each line having associated therewith a predetermined voltage output. A second set of selectably-actuable voltage lines is operatively connected in parallel to a second terminal of the heating element, each line having associated therewith a predetermined voltage output. One of the first set of selectably-actuable voltage lines and one of the second set of selectably-actuable voltage lines are activated as required.

11 Claims, 3 Drawing Sheets

POWER CONTROL SYSTEM FOR A THERMAL INK-JET PRINTER

This is a continuation of application Ser. No. 08/198,714, filed Feb. 18, 1994, abandoned.

This Application incorporates by reference U.S. Pat. No. 5,223,853, assigned to the assignee hereof.

The present invention relates to a high-speed, high-efficiency, high-precision voltage control system for a thermal ink jet printhead.

In thermal ink jet printing, droplets of ink are selectively emitted from a plurality of drop ejectors in a printhead, in accordance with digital instructions, to create a desired image on a surface. The printhead typically comprises a linear array of ejectors for conveying the ink to the sheet. The printhead may move back and forth relative to a surface, for example to print characters, or the linear array may extend across the entire width of a sheet (e.g. a sheet of plain paper) moving relative to the printhead. The ejectors typically comprise capillary channels, or other ink passageways, forming nozzles which are connected to one or more common ink supply manifolds. Ink from the manifold is retained within each channel until, in response to an appropriate digital signal, the ink in the channel is rapidly heated and vaporized by a heating element disposed within the channel. This rapid vaporization of the ink creates a bubble which causes a quantity of ink to be ejected through the nozzle to the sheet.

U.S. Pat. No. 5,223,853, entitled "Electronic Spot Size Control in a Thermal Ink Jet Printer," discloses a system by which ink jet droplets of a consistent size may be ejected from a thermal ink jet printhead, regardless of the original temperature of the liquid ink in the printhead. As described in detail in that patent, one of the most crucial parameters for image quality in an ink jet printer is the spot size of individual droplets of ink emitted from the printhead, and in turn the most crucial parameter for determining the spot size of individual droplets is the temperature of the liquid ink immediately before ejection. The system of U.S. Pat. No. 5,223,853 operates on the principle of first measuring the temperature of the liquid ink in the printhead and then, in response to this measured temperature, providing to the printhead an optimal combination of power (typically voltage) and pulse duration to a heating element which is used to vaporize the liquid ink and cause it to be ejected from the printhead. From the standpoints of preventing overheating of the printhead chip, avoiding kogation of ink within the printhead, and other practical concerns, a selected pulse duration must be coupled with an appropriate power level, and vice-versa. For each measured temperature there is provided in this system a best combination of power and pulse width, as opposed to a system which merely increases or decreases one input or the other.

In a typical configuration of a thermal ink jet printhead, a linear array of ejectors, in one embodiment 128 ejectors spaced 300 to the inch, is caused to move across a sheet in which an image is to be printed. The ejectors are activated, as necessary according to the desired image, in groups of four ejectors at a time across the array, while the array itself moves across the sheet. Thus, in some situations a set of ejectors may be activated every 4 microseconds. In order to realize a spot size control system such as in U.S. Pat. No. 5,223,853, a system for providing the best combination of power and pulse duration must be able to react to very quick changes in temperature of the liquid ink in the printhead, particularly as the action of the printhead itself is the main contributor to changes in temperature of the liquid ink. In a realistic practical application, the temperature of liquid ink in the printhead could change significantly within 200 microseconds. Further, because the necessary combination of voltage and pulse duration for one temperature may be completely different from that for the "neighboring" temperature, a control system may have to change its voltage very abruptly, for example, from 38 volts to 41 volts, in a stepwise manner with minimal time for transition.

In addition to the problems of time lag associated with traditional analog voltage-supply devices, which can typically change voltage at no more that 1 volt per millisecond, there is the problem that such power supply devices operate on the principle of "throwing voltage away" when a lesser voltage is suddenly needed. When voltage is reduced by an analog circuit, the power which is not output in the form of a voltage is at least temporarily dissipated as heat. To provide such a power supply within a small ink jet printer would be to introduce an unpredictable source of external heat, which could further distort the performance of the printhead. For these reasons, a power supply system is needed for ink jet printers which is of very quick response, and which provides accurate voltage levels as needed without generation of excess heat.

In the prior art, U.S. Pat. No. 5,017,948 discloses a control system for an ink-jet printer in which the voltage applied to the heating elements is adjusted as a function of the number of heating elements actuated at a given time.

U.S. Pat. No. 5,083,137 discloses a control system for an ink-jet printer in which the voltage applied to the heating elements is compared to a reference voltage through a comparator, the output of the comparator being applied to the gate of a PMOS driver driving the heating elements.

According to the present invention, there is provided, in a printing apparatus wherein heat is applied from a heating element to a quantity of liquid ink, a system for controlling power associated with the heating element. A first set of selectably-actuable voltage lines is operatively connected in parallel to a first terminal of the heating element, each line having associated therewith a predetermined voltage output. A second set of selectably-actuable voltage lines is operatively connected in parallel to a second terminal of the heating element, each line having associated therewith a predetermined voltage output. One of the first set of selectably-actuable voltage lines and one of the second set of selectably-actuable voltage lines are actuated as required.

Figure 3:
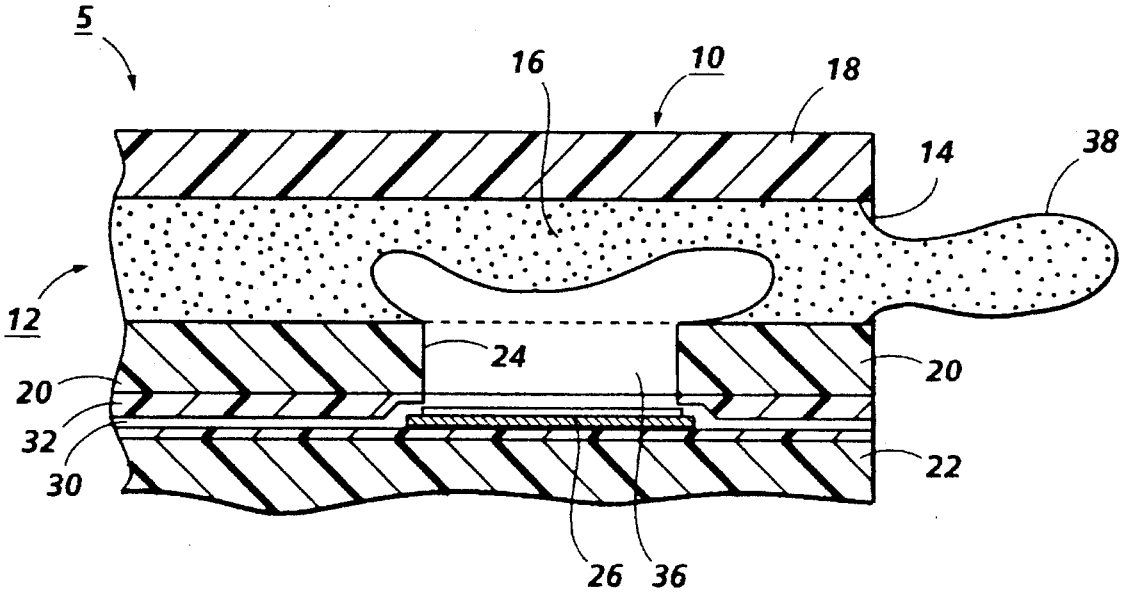
FIG. 3 PRIOR ART
FIG. 3 is a cross-sectional view of a thermal ink jet ejector as would be used with the present invention.

FIG. 3 is a fragmentary sectional elevational view of a single drop ejector 10 of an ink jet printhead, one of a large plurality of such ejectors which would be found in one version of an ink jet printhead. Typically, such ejectors are sized and arranged in linear arrays of 300 or more ejectors per inch. As will be used in the detailed description, a silicon member having a plurality of channels for drop ejectors defined therein is known as a "die module" or "chip," and is here indicated generally as 5. In currently popular designs, a typical chip such as 5 includes as many as 128 ejectors 10, spaced 300 or more to the inch. In designs with multiple chips, each chip may include its own ink supply manifold, or multiple chips may share a single common ink supply manifold.

Each ejector, or nozzle, generally indicated as 10, includes a capillary channel 12 which terminates in an orifice 14. The channel 12 regularly holds a quantity of ink 16 which is maintained within the capillary channel 12 until such time as a droplet of ink is to be ejected. Each of a plurality of capillary channels 12 are maintained with a supply of ink from an ink supply manifold (not shown). The channel 12 is typically defined by an abutment of several layers. In the ejector shown, the main portion of channel 12 is defined by a groove anisotropically etched in an upper substrate 18, which is made of a crystalline silicon. The upper substrate 18 abuts a thick-film layer 20, which in turn abuts a lower silicon substrate 22.

Sandwiched between thick film layer 20 and lower substrate 22 are electrical elements which cause the ejection of a droplet of ink from the capillary channel 12. Within a recess 24 formed by an opening in the thick film layer 20 is a heating element 26. The heating element 26 is typically protected by a protective layer 28 made of, for example, a tantalum layer having a thickness of about 0.5 microns. The heating element 26 is electrically connected to an addressing electrode 30. Each of the large number of ejectors 10 in a printhead will have its own heating element 26 and individual addressing electrode 30, to be controlled selectively by control circuitry, as will be explained in detail below. The addressing electrode 30 is typically protected by a passivation layer 32.

When an electrical signal is applied to the addressing electrode 30, energizing the heating element 26, the liquid ink immediately adjacent the element 26 is rapidly heated to the point of vaporization, creating a bubble 36 of vaporized ink. The force of the expanding bubble 36 causes a droplet 38 of ink to be emitted from the orifice 14 onto the surface of a sheet. The "sheet" is the surface on which the mark is to be made by the droplet, and may be, for example, a sheet of paper or a transparency.

In imparting energy to liquid ink in the capillary channel 12 to cause ejection thereof, the electrical energy converted to thermal energy by heating element 26 may be controlled by either of two variables: the voltage applied to the heating element 26, or the time duration of the voltage pulse to cause the ejection of droplet 38. The minimum voltage applied to heating element 26 to cause the ejection of droplet 38 is known as the "threshold voltage." The voltage applied to heating element 26 must be in excess of this threshold voltage; however, if the applied voltage to heating element 26 is excessively greater than the drop voltage, not only will there be a waste of energy in operating the printhead, but the excess voltage will ultimately cause the printhead to overheat, thus increasing the temperature of the liquid ink in the printhead, very likely affecting the spot size. Further, excessive voltage will significantly decrease the working life of the printhead, either by gradually baking ink residue onto the heating elements, or by catastrophically causing an open circuit in the heating element. Similar temperature and wear problems may result from excessive duration of the voltage pulses applied to the heating element 26.

Figure 1:
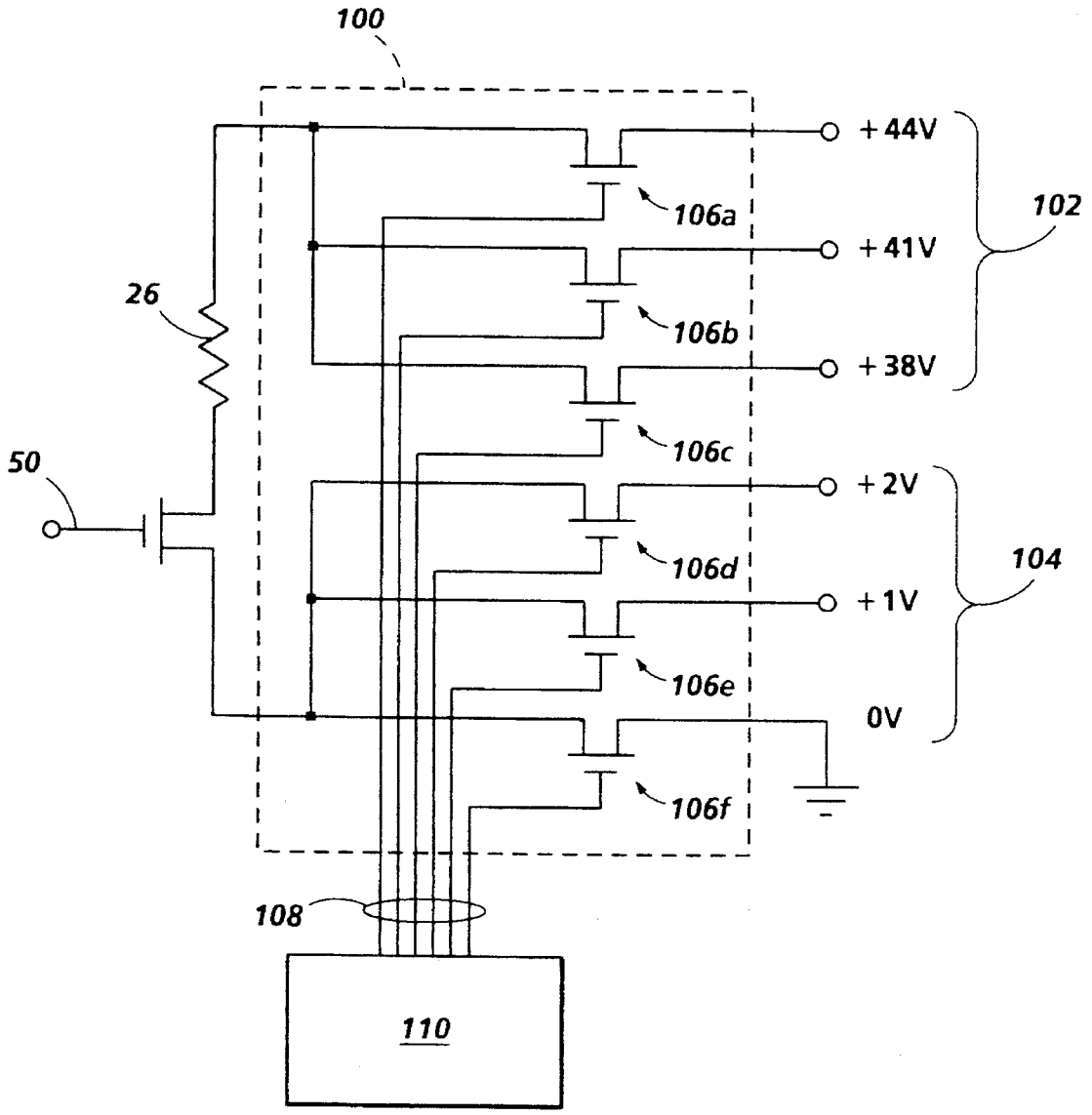
FIG. 1 is a schematic diagram showing a switching system according to the present invention.

FIG. 1 is a schematic view of the voltage control system of the present invention. Operatively connected to each heating element 26 (shown as a resistor in FIG. 1) is a switch battery 100. The inputs into switch battery 100 are, in this embodiment, three main voltage lines, indicated as 102, and three adjustment lines, indicated as 104. Each of the main voltage lines 102 and adjustment lines 104 are arranged in parallel with the heating element 26, with the main voltage lines 102 being operatively connected on one side of the resistor forming heating element 26 and the adjustment lines connected to the other side of the resistor. Each of the main voltage lines 102 and adjustment lines 104 are connected to an external voltage supply (not shown) to supply positive voltage, with the exception of the adjustment line 104 connected to ground, which is used when no adjustment is required, as will be explained below.

Each of the main voltage lines 102 and adjustment lines 104 include a transistor switch, indicated as 106*a* . . . 106*f*. Each of these transistor switches is in turn controlled by an individual control line, collectively indicated as control bus 108, to a selection circuit indicated generally as 110. As is apparent from FIG. 1, in order to complete a circuit from an external voltage source through the heating element 26, it is necessary to activate the switches to close the circuit between one of the main voltage lines 102 and at least one adjustment line 104. As configured in FIG. 1, the illustrated system is designed to supply an integral number of volts from 36 to 44 volts through heating element 26 when drive transistor 50 is activated to complete the entire circuit. The three main voltage lines are adapted to supply 44, 41, and 38 volts respectively; in order to obtain other integral voltages between 36 and 44 volts, the adjustment lines 104 may be used. Since the adjustment lines 104 are of the same voltage sign as the main voltage lines, the effect of applying the small positive voltages to the other side of the heating element 26 as the main voltage lines 102 is to subtract a certain small amount of voltage from the main voltage line. For example, in order to obtain 42 volts through the heating element 26, the selection circuit 108 would close transistors 106*a* and 106*d*, yielding a voltage of (+44)−(+2)=+42 volts. If a voltage of 41 volts is needed, however, the selection circuit 110 could close transistor switch 106*b* and transistor switch 106*f*, so that the exact 41 volts from the line associated with 106*b* will pass through the heating element 26 and go directly to ground, as shown. In this way, the built of the voltage is sent through the main voltage lines 102, and the adjustment lines 104 are used to make small adjustments. Of course it may be desirable to provide more adjustment lines 104, such as differentiated by 0.5-volt intervals, if a higher voltage resolution is desired in the system, or if it is desired to have more than a three-volt difference between main voltage lines 102. Likewise, it is possible to have more main voltage lines to extend the accessible range of voltages.

Figure 2:
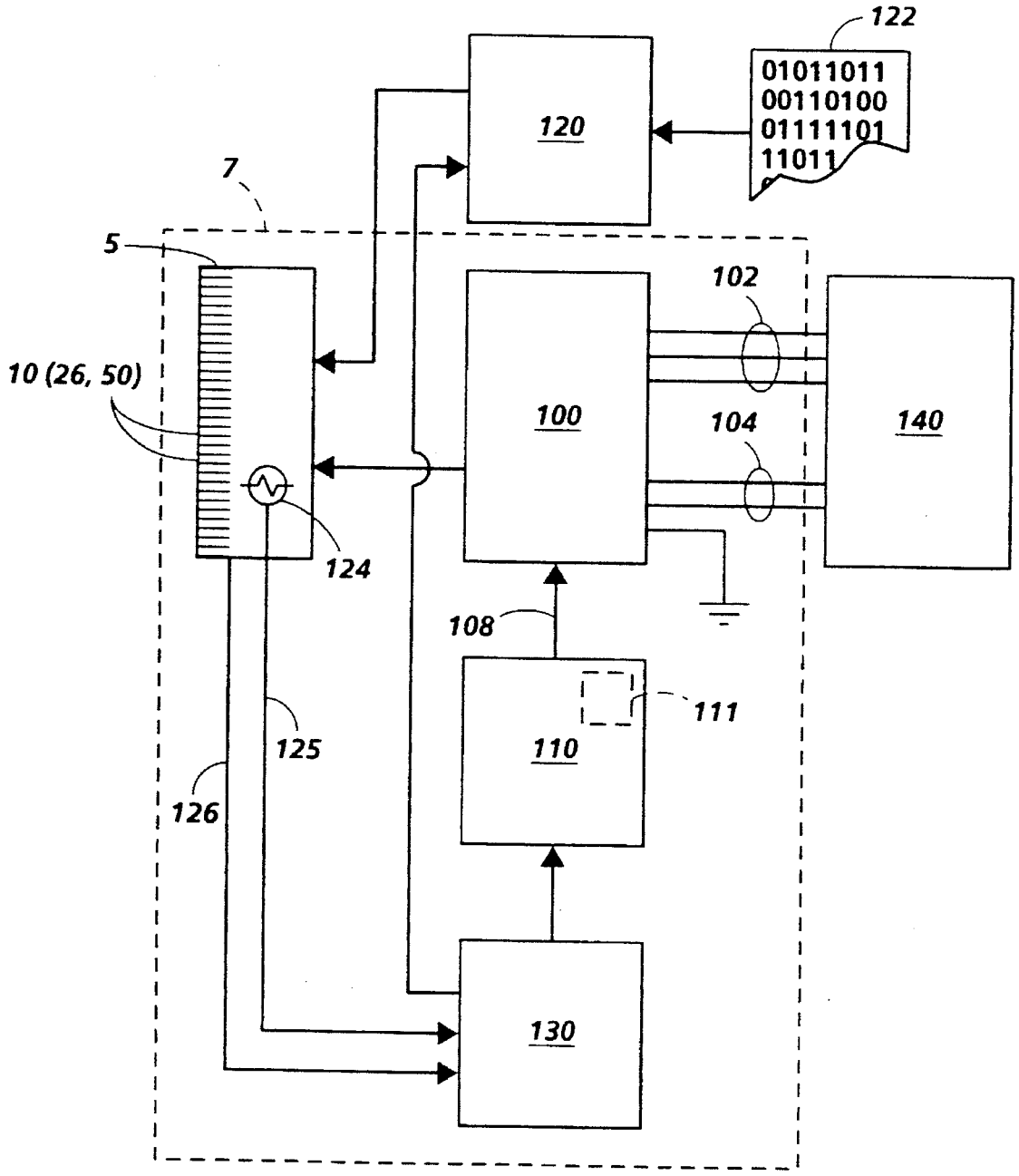
FIG. 2 is a systems diagram showing the system of the present invention in the context of a high-precision ink jet printer.

FIG. 2 is a systems diagram showing how a switch battery 100 according to the present invention is incorporated in a high-precision thermal ink jet printing system. There is shown in FIG. 2 a printhead 5 including a plurality of ejectors 10, each ejector 10 including a heating element (such as 26 in FIG. 1) and drive transistor (such as 50 in FIG. 1) to activate the heating element. The inputs into the printhead 5 include an image control system generally shown as 120, which activates certain of the ejectors 10 in printhead 5 as needed, as the printhead 5 moves relative to a print sheet, in order to produce a desired image on the sheet. The inputs to image control system 120 include the image data for the desired to be printed, which is shown generally as 122, and information about the desired pulse duration for which each heating element will be activated. In other words, and referring to FIG. 1, the pulse duration will be the amount of time drive transistor 50 is activated when it is desired to activate a particular ejector at a particular time.

Certain real-time feedback outputs from the printhead 5 are useful in a high-precision system. Among these outputs are a temperature of the printhead from which a temperature of the liquid ink therein may be inferred, and the specific identity of which ejectors 10 along the linear array are being activated at a given moment. For measuring temperature, there is provided on the printhead 5 at least one thermistor 124 (or other temperature measuring device) which is able to maintain a real-time monitoring of the printhead temperature. The other important real-time output from printhead 5 is which ejectors 10 are being activated at a given moment; ejectors toward the middle of a linear array are likely to have significantly different loss properties than ejectors toward the end of a linear array, and therefore certain types of compensation may be required. There is thus shown in FIG. 2 two lines from the printhead 5, line 125 from thermistor 124, and a ejector position monitoring line 126 (although the data of which set of ejectors are being activated may also come from image control system 120). These inputs are then fed into a selector indicated as 130. The purpose of selector 130 is to take the inputs of instantaneous temperature and ejector position and select, typically based on look-up tables embodied in software, an optimal combination of voltage and pulse duration for firing the individual heating elements 26. Such a system for obtaining the optimal set of parameters in response to temperature and other variables is given in U.S. Pat. No. 5,223,853, incorporated by reference herein.

When the optimal combination of voltage and pulse duration are determined by selector 130, data representative of the optimal pulse duration is sent to image control system 120, which in turn operates the drive transistors 50 as needed in printhead 5. The data for optimum voltage is sent to selection circuit 110, the function of which has been described above. The output of selection circuit 110, through control bus 108, may typically be in the form of a digital word, with the 1's and 0's indicating whether a given switch in the switch battery 100 will be activated. If, for instance, a value of 42 volts is needed, it will be necessary (returning to FIG. 1) to activate transistor switches 106*a* and 106*d*. If the digital word is read down from the transistor switches in FIG. 1, and 1 indicates a closed switch, the activation of transistor switches 106*a* and 106*d* will appear as 100100. To take another example, if a value of 41 volts is required, transistor switches 106*b* and 106*f* will be activated, for a digital word of 010001. In order to make use of serial data, selection circuit 110 may include a serial-to-parallel converter 111, of a design which would be known to one of skill in the art, adapted to receive a serial word from selector 130 and convert it to parallel form for output through the multiline control bus 108.

It is intended that switch battery 100, selection circuit 110, and perhaps even selector 130 and a portion of image control system 120, be formed on a single silicon chip. Indeed, one or more of these elements may be formed on the chip forming the printhead itself as shown by the dotted line in FIG. 2: the area indicated as 7 shows that certain elements, including the printhead ejectors 10 and their associated heating elements 26, can be placed on a single chip and interconnected thereon by means known in the art.

The functioning of switch battery 100 depends on a constant supply of voltages being supplied for main voltage lines 102 and adjustment lines 104. These voltages are preferably supplied by an external device such as 140, which in turn can be connected to the general power supply for an entire printer (not shown).

The practical advantages of the switching battery of the present invention are significant. First, using well-known transistor technology, a switching battery can be provided which can vary the voltage to the printhead in a substantially instantaneous fashion within every 200 microseconds, regardless of the start or end points of the voltage change; in contrast, an analog voltage supply generally cannot change more than 1 volt per millisecond. The lack of power dissipation avoids the presence of an extra source of heat within the printer or printhead. The simplicity of the design of the switching battery 100 enables it to be embodied on a silicon chip, or even directly on the chip forming the printhead itself. In brief, the switching battery in the present invention enables an electronic spot size control system having a response easily sufficiently fast for changes in conditions in the course of use of the printer, and even within the course of a single "cycle" of ejectors being activated across a linear array.

While the invention has been described with reference to the structure disclosed, it is not confined to the details set forth, but is intended to cover such modifications or changes as may come within the scope of the following claims.

What is claimed is:

1. A system for controlling a plurality of heating elements arranged in a single linear array on a silicon chip in a printing apparatus wherein heat is applied by a selected one of the heating elements to a quantity of liquid ink, each heating element having a first terminal and a second terminal, comprising:

a switch battery disposed on the silicon chip, including a first set of selectably-actuable voltage lines, each line having associated therewith a predetermined constant voltage output and an actuating transistor switch, a second set of selectably-actuable voltage lines, each line having associated therewith a predetermined constant voltage output and an actuating transistor switch, and means for actuating one of the first set of selectably-actuable voltage lines and one of the second set of selectably-actuable voltage lines to yield a constantly-available desired total voltage from the switch battery;

a drive transistor associated with each heating element in the linear array, for applying the constantly-available total voltage from the switch battery to the heating element; and means for activating the drive transistor of each heating element in the linear array according to image data.

2. The system of claim 1, the switch battery having associated therewith means for accepting a digital word, the first and second set of selectably-actuable voltage lines being responsive to the digital word for activation thereof to yield the desired total voltage.

3. The system of claim 2, further comprising means for converting the digital word from serial to parallel form.

4. The system of claim 1, further comprising a substantially constant voltage source operatively connected to each of the first set of selectably-actuable voltage lines.

5. The system of claim 1, further comprising a substantially constant voltage source operatively connected to one of the second set of selectably-actuable voltage lines.

6. The system of claim 1, wherein one of the first set of selectably-actuable voltage lines is of a like voltage polarity as one of the second set of selectably-actuable voltage lines.

7. The system of claim 1, wherein each of the first set of selectably-actuable voltage lines and each of the second set of selectably-actuable voltage lines are of non-opposite-sign voltage polarities.

8. The system of claim 1, further comprising:

means responsive to a measured temperature of the liquid ink in the printhead, and means for selecting a desired combination of voltage and pulse duration for the heating element based on the measured temperature of the liquid ink.

9. The system of claim 1, wherein the printing apparatus includes a plurality of heating elements, and further comprising means responsive to the location of the heating element being activated relative to other heating elements in the plurality.

10. The system of claim 1, wherein each of the first set of selectably-actuable voltage lines in the switch battery is connectable to a first terminal of each of the plurality of heating elements, and each of the second set of selectably-actuable voltage lines in the switch battery is connectable to a second terminal of each of the plurality of heating elements.

11. The system of claim 1, wherein the actuating means, in combination with the transistor switches in the switch battery, is capable of changing the total voltage within not more than 200 microseconds.

* * * * *